US008590313B2

(12) United States Patent
Graves et al.

(10) Patent No.: US 8,590,313 B2
(45) Date of Patent: Nov. 26, 2013

(54) PRECISION COUNTER-SWIRL COMBUSTOR

(75) Inventors: Charles B. Graves, Avon, IN (US); William G. Cummings, Indianapolis, IN (US)

(73) Assignee: Rolls-Royce Corporation, Indianapolis, IN (US)

( * ) Notice: Subject to any disclaimer, the term of this patent is extended or adjusted under 35 U.S.C. 154(b) by 817 days.

(21) Appl. No.: 12/182,420

(22) Filed: Jul. 30, 2008

(65) Prior Publication Data

US 2010/0024427 A1 Feb. 4, 2010

(51) Int. Cl.
*F23R 3/04* (2006.01)

(52) U.S. Cl.
USPC ..... 60/752; 60/796; 60/797; 60/804; 60/748

(58) Field of Classification Search
USPC ..... 29/889.2; 60/748, 752, 754, 758, 760, 60/804, 796, 797, 800
See application file for complete search history.

(56) References Cited

U.S. PATENT DOCUMENTS

| | | | | |
|---|---|---|---|---|
| 2,547,619 | A | 4/1951 | Buckland | |
| 2,699,040 | A | 1/1955 | Gaubatz | |
| 3,500,639 | A | 3/1970 | Stamm | |
| 3,905,192 | A * | 9/1975 | Pierce et al. | 60/737 |
| 3,981,142 | A | 9/1976 | Irwin | |
| 4,054,028 | A * | 10/1977 | Kawaguchi | 60/39.23 |
| 4,216,652 | A * | 8/1980 | Herman et al. | 60/748 |
| 4,244,178 | A * | 1/1981 | Herman et al. | 60/754 |
| 4,748,806 | A | 6/1988 | Drobny | |
| 4,875,339 | A | 10/1989 | Rasmussen et al. | |
| 5,067,324 | A | 11/1991 | Beytes et al. | |
| 5,235,805 | A | 8/1993 | Barbier et al. | |
| 5,323,601 | A | 6/1994 | Jarrell et al. | |
| 5,337,583 | A | 8/1994 | Giles et al. | |
| 5,524,430 | A | 6/1996 | Mazeaud et al. | |
| 5,560,197 | A | 10/1996 | Ansart et al. | |
| 5,581,999 | A | 12/1996 | Johnson | |
| 5,590,530 | A | 1/1997 | Owen et al. | |
| 5,687,572 | A | 11/1997 | Schrantz et al. | |
| 6,351,949 | B1 | 3/2002 | Rice et al. | |
| 6,675,587 | B2 | 1/2004 | Graves et al. | |
| 2004/0261419 | A1 | 12/2004 | McCaffrey et al. | |

OTHER PUBLICATIONS

K. Ramamurthi, Characteristics of flow through small sharp-edged cylindrical orifices, Feb. 1999, Flow measurement and Instrumentation 10 (1999), p. 133-143.*

* cited by examiner

*Primary Examiner* — William H Rodriguez
*Assistant Examiner* — Steven Sutherland
(74) *Attorney, Agent, or Firm* — McCormick, Paulding & Huber LLP

(57) ABSTRACT

A precision counter-swirl combustor that includes an annular combustor having a forward end, an aft end opposite the forward end, and an interior. The aft end being proximal to a gas turbine. The combustor further includes a fuel inlet and swirler operatively connected to the forward end and at least one air inlet. The air inlet is equipped with a chute that extends into the interior of said combustor. The combustor is secured to a fixed structure proximate the forward end of the combustor.

4 Claims, 6 Drawing Sheets

PRECISION COUNTER-SWIRL COMBUSTOR

GOVERNMENT RIGHTS

The U.S. government may have certain rights in this invention, pursuant to Contract No. N00019-04-C-0093.

FIELD OF THE INVENTION

The present invention relates generally to a counter-swirl combustor and more specifically to a precision counter-swirl combustor.

BACKGROUND OF THE INVENTION

In a gas turbine, engine air is mixed with fuel in a combustor. The combustor includes a combustion chamber in which the mixture of air and fuel is burned. Combustors are typically either cylindrical "can" combustors or are annular in shape. In an annular combustor, fuel is metered and injected into the combustor by multiple nozzles along with combustion air. The combustion air is swirled with the fuel via swirlers to create a relatively uniform mixture of air and fuel.

Uniformity is important in that if thorough mixing is not achieved, a non-uniform temperature variation of combustion products exiting the combustor will result. This, in turn, could potentially subject downstream turbine components to localized overheating. Such overheating could affect the durability of downstream turbine parts and could potentially decrease overall turbine efficiency and longevity. As will be readily appreciated, the more thorough the mixture of fuel and air, the lower the likelihood of localized overheating.

With the forgoing issues in mind, it is the general object of the present invention to provide a precision counter-swirl combustor that provides a level of temperature uniformity presently unknown in the art. In particular, it is the general object of the present invention to provide a precision forward-mounted counter-swirl combustor that employs air jets equipped with chutes, which allow for a degree of temperature uniformity presently unknown in the art.

SUMMARY OF THE INVENTION

It is an object of the present invention to provide an annular precision counter-swirl combustor.

It is another object of the present invention to provide an annular precision counter-swirl combustor that has an improved combustor exit temperature uniformity.

It is yet another object of the present invention to provide an annular precision counter-swirl combustor that has an improved combustor exit temperature uniformity through the use of air jets equipped with chutes.

It is an addition object of the present invention to provide an annular precision counter-swirl combustor that is forward mounted and that employs air jets equipped with chutes to impart an improved combustor exit temperature uniformity.

It is a further object of the present invention to provide a forward mounted annular precision counter-swirl combustor which addresses the effect of disturbances in the flow-field due to an upstream repeating feature such as a mounting strut.

These and other objects of the present invention will be better understood in view of the Figures and preferred embodiment described.

According to an embodiment of the present invention, an annular precision counter-swirl combustor includes a combustor having a forward end, an opposite aft end, and an interior. The combustor further including a fuel nozzle operatively connected to the forward end and a swirler for mixing fuel and air operatively connected to the forward end. The combustor also features at least one air inlet on said combustor, the air inlet including a chute for directing a passage of air through the inlet into the interior of the combustor. The combustor is secured to a fixed structure proximate the forward end of the combustor.

DETAILED DESCRIPTION OF THE PREFERRED EMBODIMENT

Figure 1A:
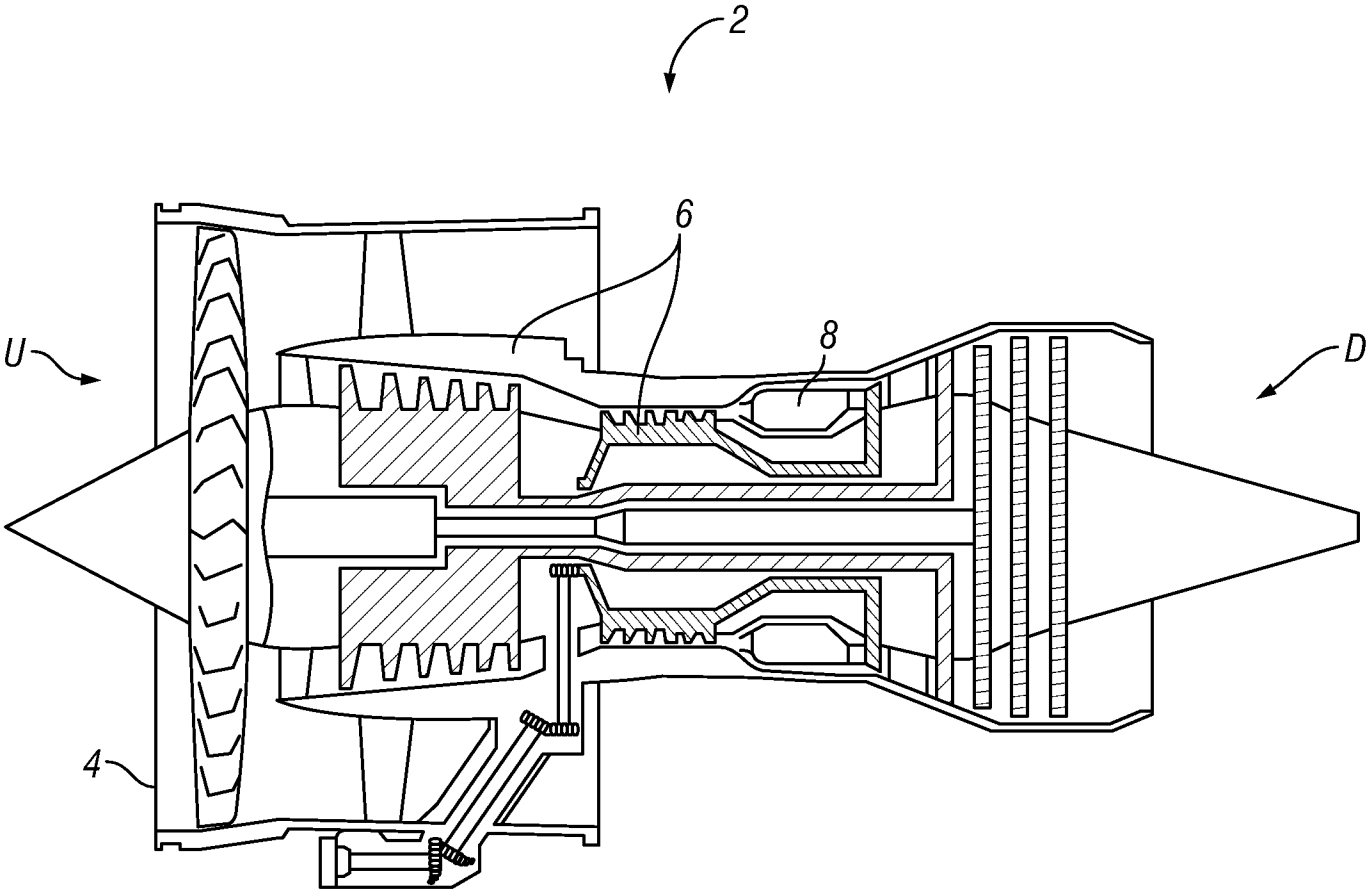
FIG. 1A is a sectioned side view of a gas turbine engine incorporating an annular combustor.

FIG. 1A depicts a gas turbine engine 2 of conventional overall configuration equipped with an annular combustor 8. In operation, air drawn in by a fan 4 at the upstream end U of the engine 2 is compressed by two axial flow compressors 6 before being directed into the annular combustor 8. In the combustor 8, the compressed air is mixed with liquid fuel and the mixture is combusted. The resultant hot combustion products then expand through a series of turbines before being exhausted through a propulsive nozzle at a downstream end D of the engine 2.

Figure 1B:
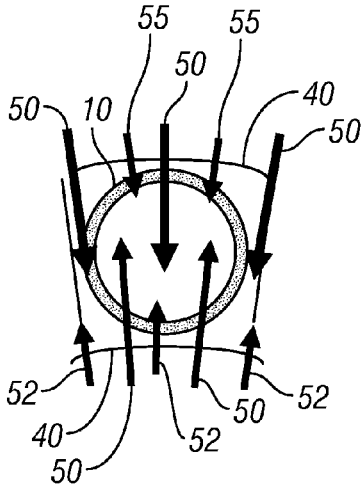
FIGS. 1B-1C are sectioned front views of a combustor depicting streams of air flowing into a combustion chamber through inlets and gaps in the streams of air to facilitate mixing of air and fuel.
Figure 1C:
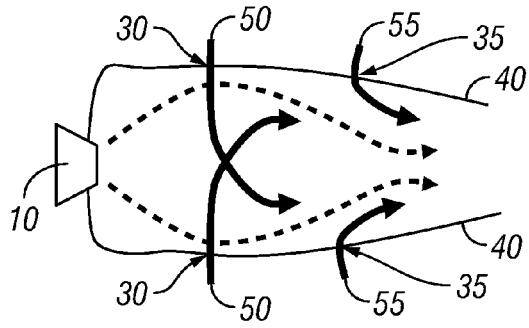

Referring now to FIGS. 1B and 1C, annular combustors typically employ an array of fuel nozzles (not shown), each nozzle being located on or near a centerline of an air swirler/air injector 10 in the forward bulkhead of a combustor 20. In general, the fuel nozzles spray fuel into the combustor and the swirler mixes air with the sprayed fuel. Typically, air from a swirler issues in a conical pattern generating a recirculation zone inside the cone and, in some instances, a torroidal recirculation zone outside the cone. This rotating flow of air from the swirler directs a spray of fuel from a nozzle radially outward to where the majority of air is located since the fuel is denser than the surrounding air.

While air swirlers 10 are generally quite effective, the swirling motion can centrifuge hotter, less dense gasses toward a centerline of a fuel nozzle, creating a temperature "bulls-eye" at the exit of the combustor. To mitigate this effect, air swirlers 10 are typically followed by at least two rows of air inlets per injector side 40. As depicted, the inlets include primary or combustion inlets 30 and dilution inlets 35. The inlets 30, 35 let streams of cool air, referred to herein as combustion and dilution streams 50, 52, respectively, into the combustor to create a more thorough mixture, and therefore, a more uniform temperature distribution.

Figure 2A:
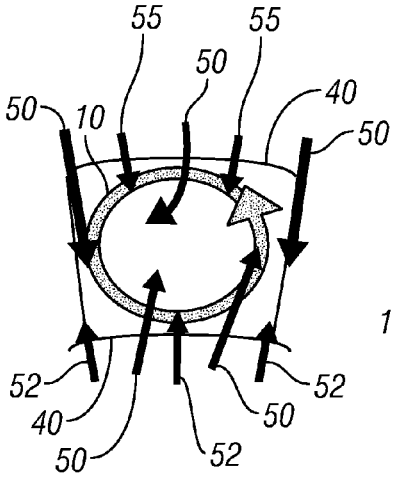
FIGS. 2A-2B are sectioned front views of the combustor of FIGS. 1A-1B in which the effect of a swirler on the streams of air resulting in a non-uniform mixture of air and fuel.
Figure 2B:
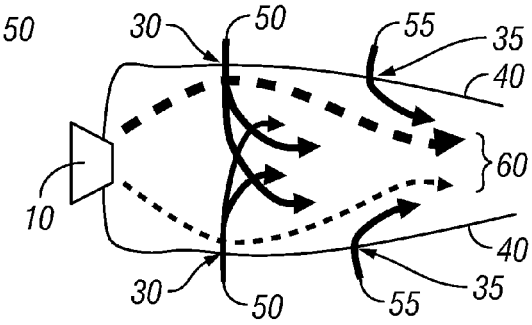

In particular, the air inlets 30, 35 attempt to direct air streams 50, 55 into the combustor to create a "picket fence" where hot gases in the combustor must pass through the focused air streams, i.e., "pickets" 50, 55 to maximize mixing. The air swirler 10 that is used in connection with such streams, however, reduces the efficacy of this approach as shown in FIGS. 2A-2B. Specifically, the air swirler 10 tends to bend or distort the streams 50, 55 creating large gaps (FIG. 2A) between individual air streams 50, 55 leading to a non-uniform mixture of fuel and air 60.

Figure 3A:
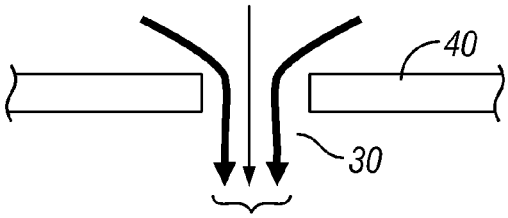
FIGS. 3A-3B are a sectioned side view and a top view, respectively, of an air inlet with a relatively low discharge coefficient illustrating a vena contracts effect on a flow of air through the inlet into a combustor.
Figure 3B:
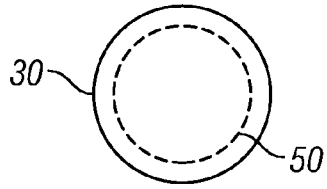
Figure 4A:
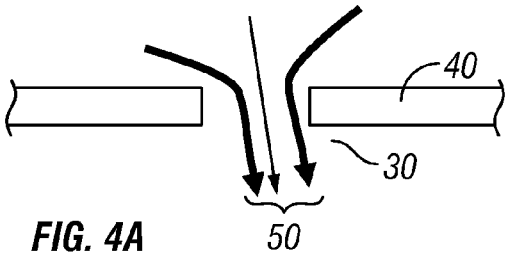
FIGS. 4A-4B are a sectioned side view and a top view, respectively, of an air inlet with a relatively low discharge coefficient illustrating susceptibility to a change in a direction of a flow of air through the inlet due to a minor pressure disturbance.
Figure 4B:
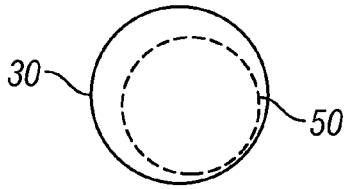

Referring now to FIGS. 3A-4B, the displacement of the air streams 50 is due, in part, to the relatively low coefficient of discharge ("Cd") of the streams 50 through the inlets 30, 35, i.e., the Cd is the effective air flow area divided by the physical area of the inlet. In FIGS. 3A and 3B, the stream or picket 50 has a relatively low Cd as a result of the sharp edges of the inlet 30. The low Cd creates significant uncertainty in the direction of the streams 50 (4A).

Figure 5A:
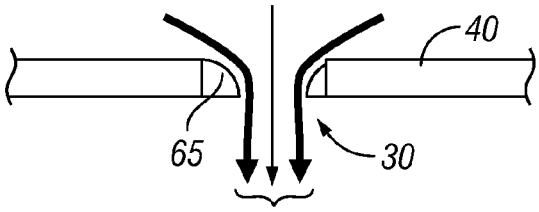
FIGS. 5A-5B are a sectioned side view and a top view, respectively, of an air inlet with a curved portion having a relatively high discharge coefficient illustrating a flow of air through the inlet into a combustor.
Figure 5B:
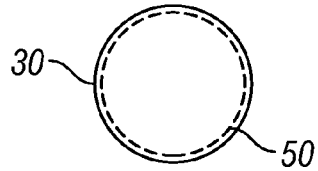

One potential solution is to provide inlets 30, 35 with rounded edges 65 as shown in FIGS. 5A and 5B, which can provide a Cd of up to 0.96. The relatively thin 0.05-inch walls of the combustor liner 40 are not easily rounded, however, as there is not enough material for rounding.

In view of the above, the present invention provides a combustor 90 that includes air inlets 70 equipped with chutes 80 as illustrated in FIGS. 6A, 6B, 7, 8 and 9. As shown, the inventive combustor 90 includes an outside liner 92 and inside liner 94 that define a combustor interior 96. The combustor 90 further includes a forward end 98 and an aft end 100. The forward end includes a hood portion 102, which contains fuel nozzles 104 and swirlers 106. The hood portion 102 is joined to the combustor 90 at a combustor bulkhead 103, which has an aperture (not shown) allowing the swirler and nozzle to direct air and fuel into the combustor interior 96. As illustrated, the chutes 80 extend into the combustor interior 96. While the chutes 80 are shown with scarfed or angled edge portion, it will be appreciated that the shape of the end portion can be varied depending on the structure of the combustor.

Figure 6A:
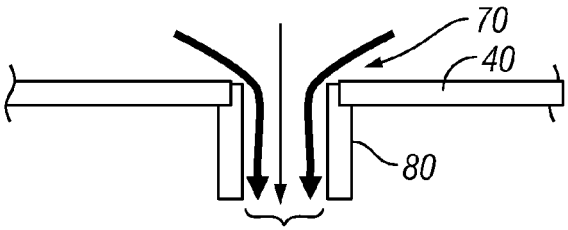
FIGS. 6A-6B are a sectioned side view and a top view, respectively, of an air inlet equipped with a chute according to an embodiment of the present invention illustrating a flow of air through the inlet into a combustor.
Figure 6B:
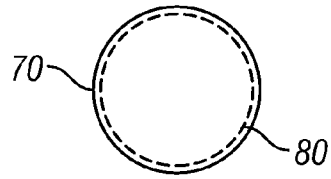
Figure 7:
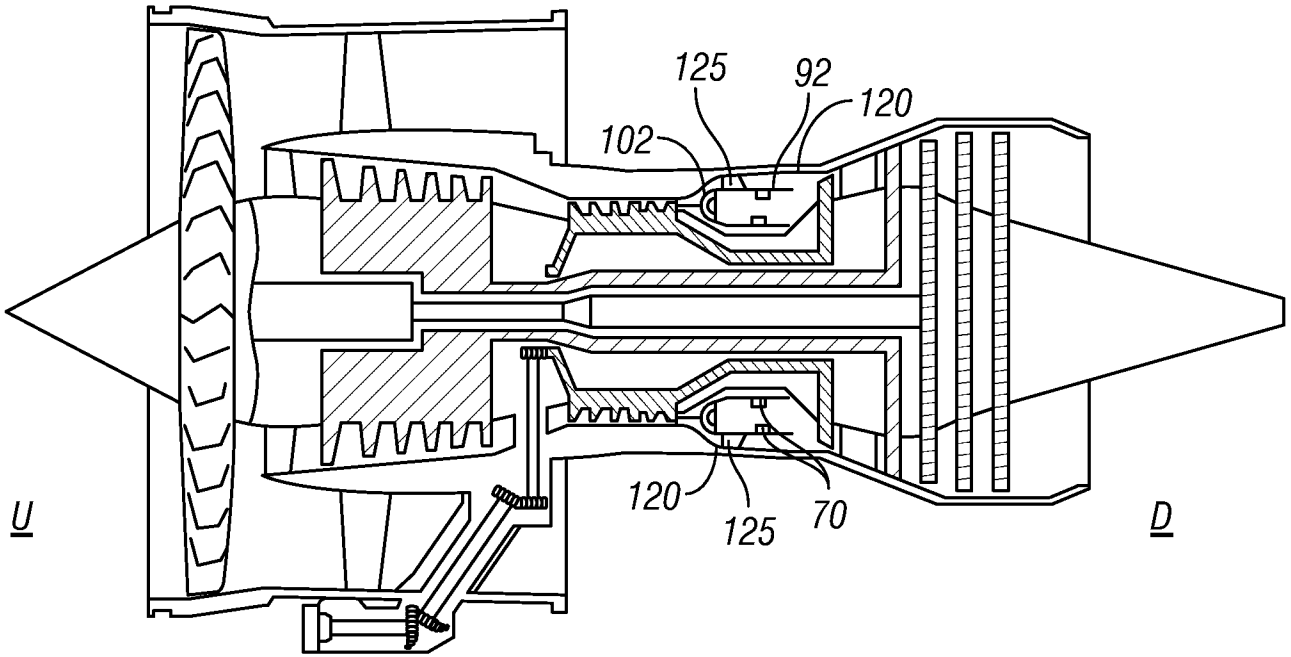
FIG. 7 is a sectioned side view of a gas turbine engine equipped with a precision counter-swirl combustor according to an embodiment of the present invention.

The chutes 80 effectively reduce the gap between the flow area and the physical area of the inlet 70 (FIG. 6B). As will be readily appreciated, this increases the Cd of each inlet significantly and results in a Cd of 0.8 or greater thereby reducing uncertainty in the location of the streams 50 into the combustor.

The chutes provide direction to the streams 50 at its initial entry into the combustor 90. Moreover, the chutes physically buttress the stream 50 and increase its penetration into and across the combustor interior. As such, by raising the Cd of the inlet 70 the chutes 80 reduce potential error and uncertainty in the location of the streams 50 present in combustors having sharp-edged inlets.

While the use of chutes 80 increases the certainty in the location of the streams 50 into the combustor to an extent, the present invention provides an even greater degree of certainty by combining the use of chutes with a forward mounted combustor 90. As stated previously, many combustors are rear or aft mounted and are secured within the engine assembly at the aft or downstream end of the combustor proximate the engine turbines. Notably, the aft end is opposite the end of the combustor that receives the fuel nozzles and the air swirlers, which is referred to as the forward end.

As will be appreciated, when the point of attachment is at the aft end, the forward end of the combustor is capable of movement, which is undesirable. In many cases, the bulkhead at the forward combustor end can shift relative to the air inlets. This movement causes the position of the fuel nozzles and air swirlers to also shift relative to the inlets. As such, the relative movement creates uncertainty in the location of the fuel nozzle and makes consistently locating combustor air inlets, and air flows, relative to the fuel nozzles difficult. In view of the above, the present invention combines air inlets with chutes with a forward combustor mount to create an annular combustor that provides a level of certainty with respect to the location of fuel nozzles and inlet air flows, and resulting uniformity in temperature profile, presently unknown in the art.

Figure 8:
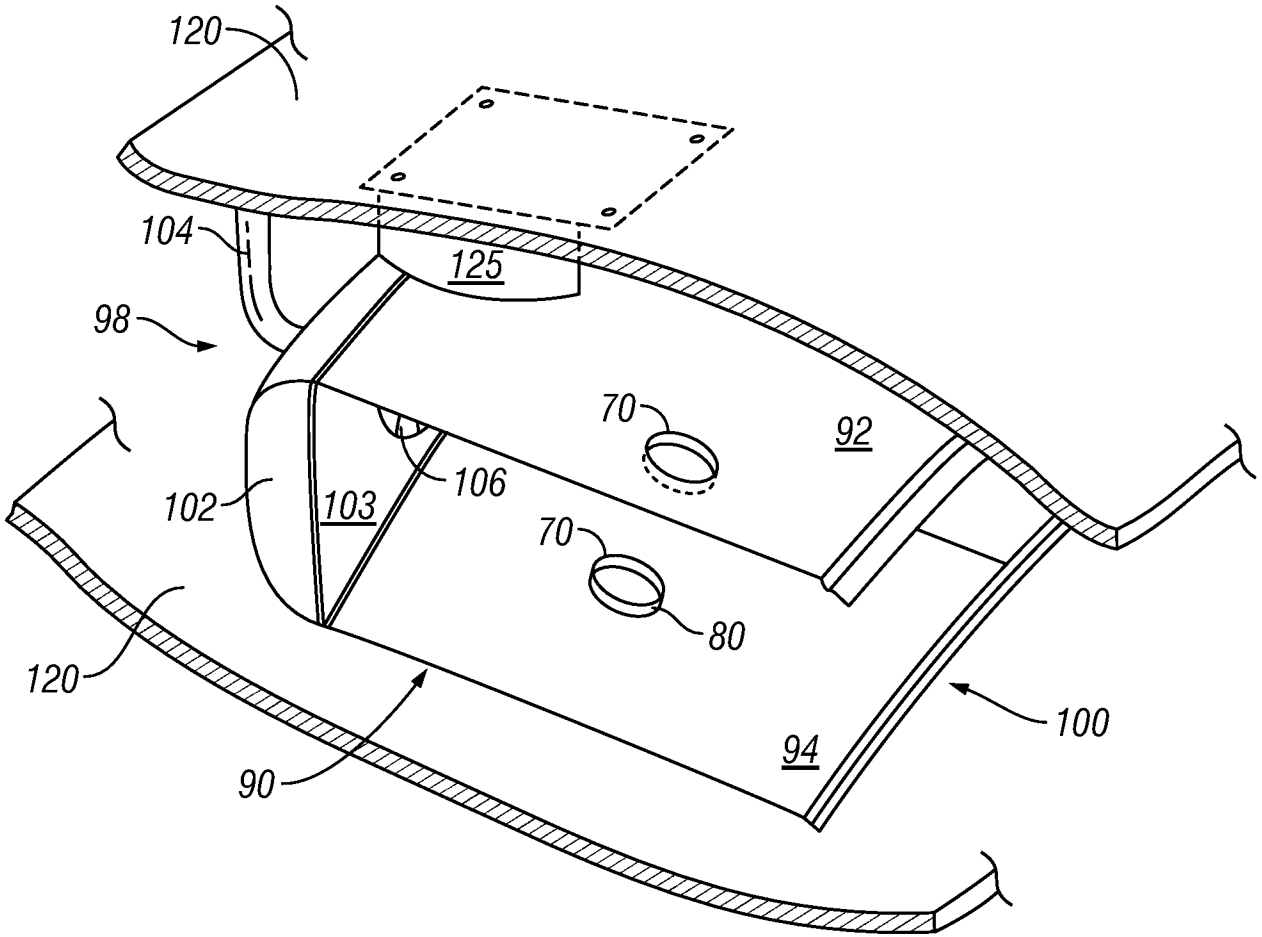
FIG. 8 is an enlarged, sectioned perspective view of the precision counter-swirl combustor of FIG. 7.
Figure 9:
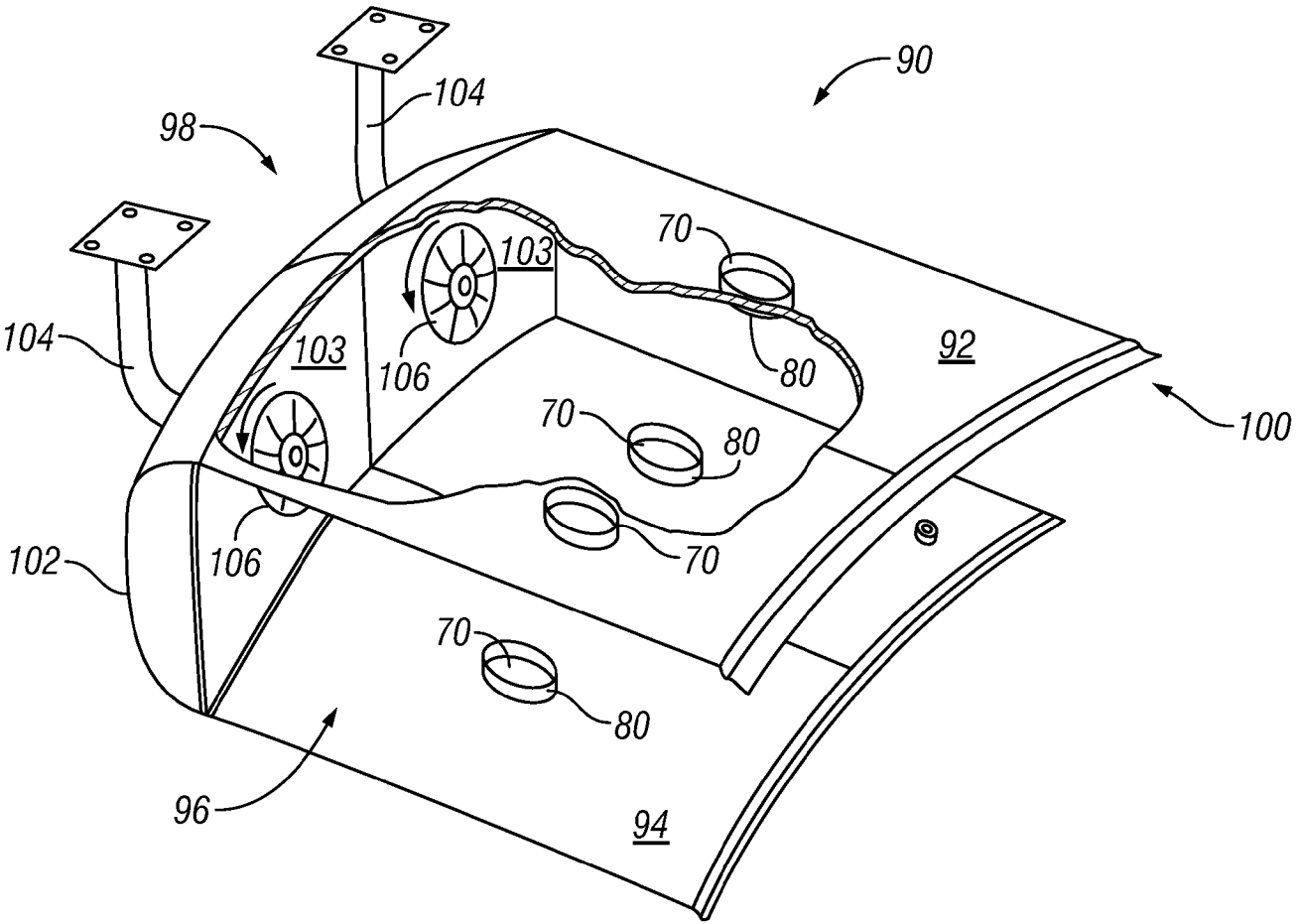
FIG. 9 is a cutaway perspective view of a combustion chamber of the precision counter-swirl combustor of FIG. 7.

Referring to FIG. 8, the inventive combustor 90 is affixed to a case 120 of the engine by a strut 125. The strut 125 extends between the case 120 and a portion of the combustor proximate its forward end 98. Preferably, the strut 125 is configured such that it effectively fixes the position of the bulkhead 103 of the combustor 90 and thereby fixes the location of the fuel nozzles 104 and swirlers 106.

The strut 125 increases the efficacy of the inventive air inlets 70 equipped with chutes 80. As stated above, the chutes have a Cd of 0.8 or greater and can direct and guide air flows precisely. In order to capitalize on this enhanced precision, the strut 125 decreases variability and uncertainty in the location of the fuel nozzle and swirler relative to the chutes. Therefore, the chutes can add a degree of precision not known in the art and can create a mixture of fuel and air with an enhanced uniformity. The enhanced uniformity in the fuel/air mixture leads to a greater uniformity in temperature of exiting combustion products, which increases the efficiency and longevity of downstream turbines.

The inventive combustor also compensates for the general effects of a forward mounted strut, or any other repeating upstream feature, on the air flow field over the combustor liners and through the inlets. As will be apparent, if the total number of struts is less than the total number of fuel nozzles and air inlets, only some air inlets, and air flows, will be affected be the presence of a strut. This could lead to a temperature increase for certain nozzles. To combat this, the air flow to the hotter nozzles could be increased by changing the area and location of, for example, an air inlet in the outside liner. That is, if every other nozzle has a strut, the inlets working in operation with the strutted nozzle can have an area or location different from the inlets without struts. As such, a pattern of inlets of multiple, different areas and/or locations could be employed to compensate for a specific strut pattern.

In sum, the present invention provides a precision annular combustor that combines air inlets with chutes and a forward combustor mounting position to increase uniformity in the mixture of air and fuel thereby creating a uniform temperature profile of combustion products exiting the combustor. Moreover, the present invention provides a method of alleviating any potential effects of a strut on air flowing into the combustor through the inlets by varying the circumference of specific inlets based on the presence or absence of a strut or other upstream repeating feature.

While many advantages of the present invention can be clearly seen from the embodiments described, it will be understood that the present invention is not limited to such embodiments. Those skilled in the art will appreciate that many alterations and variations are possible within the scope of the present invention.

What is claimed is:

1. An annular precision counter-swirl combustor comprising:

an outer combustor liner;

an inner combustor liner substantially concentric with said outer combustor liner and defining an annular combustor interior extending longitudinally from a forward end to an aft end;

a bulkhead portion at said forward end of the combustor interior;

a fuel nozzle mounted to an engine case, and operatively connected in said bulkhead portion;

a swirler for mixing fuel and air operatively connected in said bulkhead portion;

at least one air inlet per fuel nozzle on each said combustor liner, each said air inlet including a chute for directing a passage of air through said air inlet into said interior of said combustor; and an airfoil shaped strut directly securing at least said bulkhead portion and said outer liner of said combustor to the engine case, wherein one of said air inlets in said outer and inner combustor liners is laterally offset on a first side of said swirler and the other of said air inlets is laterally offset to a second side opposite of said first side of said swirler, such that said air inlets co-operate to provide a passage of air opposing a direction of swirl of fuel and air created by said swirler, and said strut preventing movement of said air inlets relative to said fuel nozzle and swirler, and precisely locating said air inlets to create a uniform mixture of fuel and air in said combustor and a uniform temperature profile of combustion products exiting said combustor through said aft end, and an area and a location of an air inlet that is substantially aligned with said strut are determined such that air flow through said air inlet aligned with said strut is substantially the same as air flow through an air inlet not aligned with said strut.

2. The precision counter-swirl combustor of claim 1 wherein said air inlet has a coefficient of discharge of at least about 0.8.

3. An annular precision counter-swirl combustor comprising:

a combustor formed by an outer combustor liner and an inner combustor liner substantially concentric with said outer combustor liner, said outer and inner combustor liners extending longitudinally from a forward end substantially closed by a bulkhead portion to an open aft end of said combustor;

a fuel nozzle operatively connected in said bulkhead portion;

an air swirler operatively connected in said bulkhead portion;

at least one air inlet per fuel nozzle on each of the inner and outer liners of said combustor, each air inlet including a chute for directing a passage of air through said inlet into said interior of said combustor; and wherein said air inlet precisely directs the passage of air to oppose a direction of swirl of fuel and air created by said air swirler, said combustor is secured by an airfoil shaped strut to a fixed structure proximate said forward end of said combustor, and said strut directly secures said bulkhead portion and said outer liner of said combustor to a surface of an engine case, and prevents relative movement between said air inlets and said bulkhead portion, thereby precisely and fixedly locating said air inlets relative to said fuel nozzle and said air swirler to create a uniform mixture of fuel and air in said combustor and a uniform temperature profile of combustion products exiting said combustor through said aft end.

4. The annular precision counter-swirl combustor of claim 3 wherein one of said air inlets in said outer and inner combustor liners is on a first side of said air swirler and the other of said air inlets is laterally offset to a second side opposite of said first side of said air swirler.

* * * * *